US009695605B2

(12) United States Patent
Jin

(10) Patent No.: US 9,695,605 B2
(45) Date of Patent: Jul. 4, 2017

(54) BATTERY POWERED CONCRETE VIBRATOR

(71) Applicant: Keyou Jin, Wenling (CA)

(72) Inventor: Keyou Jin, Wenling (CA)

( * ) Notice: Subject to any disclaimer, the term of this patent is extended or adjusted under 35 U.S.C. 154(b) by 567 days.

(21) Appl. No.: 14/348,066

(22) PCT Filed: Nov. 2, 2012

(86) PCT No.: PCT/CN2012/001482
§ 371 (c)(1),
(2) Date: Mar. 28, 2014

(87) PCT Pub. No.: WO2013/138965
PCT Pub. Date: Sep. 26, 2013

(65) Prior Publication Data

US 2014/0241105 A1 Aug. 28, 2014

(30) Foreign Application Priority Data

Mar. 23, 2012 (CN) ..... 2012 1 0079196

(51) Int. Cl.
*E04G 21/00* (2006.01)
*E04G 21/08* (2006.01)
*B06B 1/04* (2006.01)

(52) U.S. Cl.
CPC ..... *E04G 21/08* (2013.01); *B06B 1/04* (2013.01)

(58) Field of Classification Search
CPC ..... E04G 21/08; B06B 1/04
USPC ..... 366/122, 123
See application file for complete search history.

(56) References Cited

U.S. PATENT DOCUMENTS 3,410,528 A * 11/1968 Clark ..... E04G 21/08 366/123
2007/0201302 A1* 8/2007 Lindley ..... E04G 21/066 366/123
2012/0104991 A1* 5/2012 Suzuki ..... H01M 2/1055 320/103

* cited by examiner

*Primary Examiner* — Tony G Soohoo
*Assistant Examiner* — Anshu Bhatia

(57) ABSTRACT

A battery powered concrete vibrator is provided with a vibration head; a brushless DC motor disposed in the vibration head; a drive shaft disposed in the vibration head, rotatably disposed through the brushless DC motor, and operatively driven by the brushless DC motor, the drive shaft including a lengthwise groove on an outer surface, thereby rendering the drive shaft unbalanced; and a groove-shaped vibration member put on the drive shaft. The drive shaft can impart rotation to the vibration member.

4 Claims, 1 Drawing Sheet

BATTERY POWERED CONCRETE VIBRATOR

BACKGROUND OF THE INVENTION

1. Field of the Invention

The invention relates to concrete vibration devices and more particularly to a battery powered concrete vibrator.

2. Description of Related Art

Optimum oscillation frequency of a concrete vibrator is 200 Hz. Typically, there are two types of concrete vibrator available. One has an eccentric rotor which eccentrically rotates about a center of rotation in a casing so that vibration can be provided. However, it is disadvantageous due to excessive noise and unstable oscillation frequency in the range of 60 to 150 Hz. The other has a variable-frequency drive for changing frequency from 50 Hz to 200 Hz. It further includes an internal electric motor and an unbalanced mass. The motor imparts rotation to the unbalanced mass to vibrate a concrete after being regulated by the variable-frequency drive. Its advantages include low noise and high performance. Its drawbacks include reduced intensity of vibration and prohibitively high manufacturing cost. Thus, the need for improvement still exists.

SUMMARY OF THE INVENTION

The invention aims at solving problems associated with the conventional concrete vibrators including excessive noise, unstable oscillation frequency, reduced intensity of vibration, and prohibitively high manufacturing cost.

It is therefore one object of the invention to provide a battery powered concrete vibrator comprising a vibration head; a brushless direct current (DC) motor disposed in the vibration head; a drive shaft disposed in the vibration head, rotatably disposed through the brushless DC motor, and operatively driven by the brushless DC motor, the drive shaft including a lengthwise groove on an outer surface, thereby rendering the drive shaft unbalanced; and a groove-shaped vibration member put on the drive shaft; wherein the drive shaft is capable of imparting rotation to the vibration member.

Preferably, the vibration member has a concave section, and further comprises a sleeve put on the vibration member.

Preferably, further comprises a variable-frequency drive for controlling the brushless DC motor.

Preferably, further comprises a rechargeable lithium battery electrically connected to the brushless DC motor.

Preferably, the groove of the drive shaft is formed by molding.

By utilizing the invention, the following advantages are obtained: The motor speed can be varied by the variable-frequency drive disposed externally. The motor is protected by overload protection and overheat protection. The drive shaft is an unbalanced mass. The vibration member is groove-shaped. Air resistance is substantially eliminated when the drive shaft rotates in a high rotational speed. The motor has a high efficiency Intensity of the vibration member is very strong. The concrete vibrator can be operated safely. The concrete vibrator is portable. The concrete vibrator can be operated with low noise being made. The concrete vibrator causes a minimum impact to the environment. The vibration member has a stable oscillation frequency. The concrete vibrator has a prolonged useful life.

The above and other objects, features and advantages of the invention will become apparent from the following detailed description taken with the accompanying drawings.

DETAILED DESCRIPTION OF THE INVENTION

Figure 1:
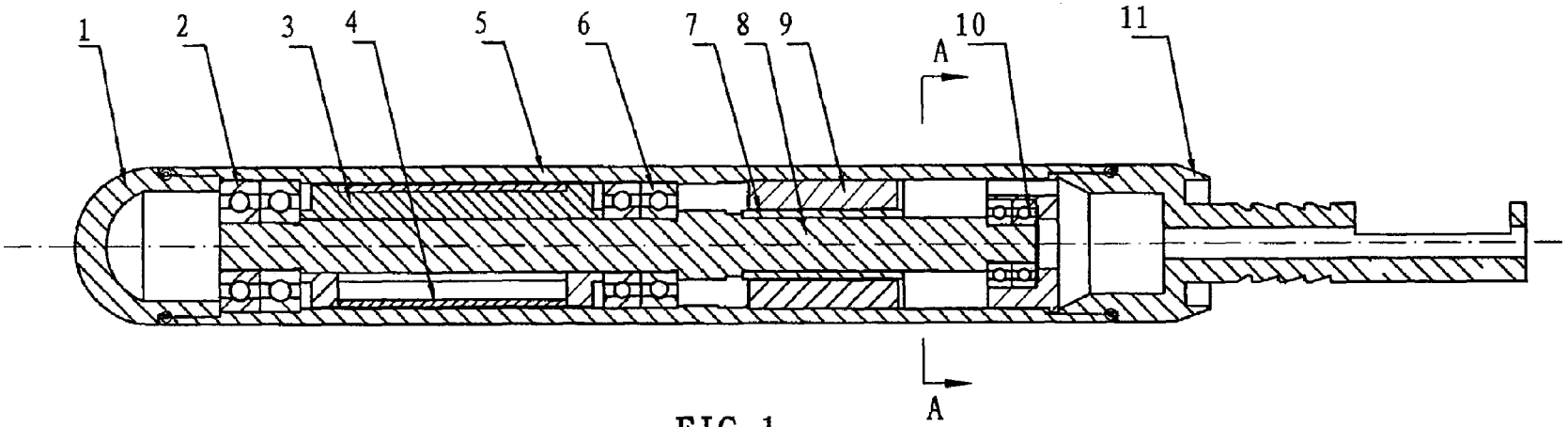
FIG. 1 is a longitudinal sectional view of a concrete vibrator according to the invention.
Figure 2:
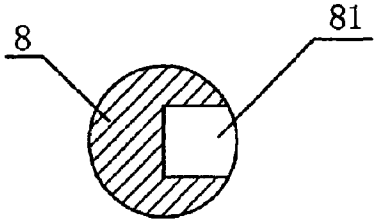
FIG. 2 is a sectional view taken along line A-A of FIG. 1.

Referring to FIGS. 1 and 2, a concrete vibrator in accordance with the invention is shown. The concrete vibrator is powered by a rechargeable lithium battery of 48V. Specifications of the concrete vibrator are follows. Oscillation frequency is 200 Hz; diameter of a vibration head is 38 mm, 50 mm, or 60 mm; length of the vibration head is about 400 mm; and output force is 3-7.5 kN.

The concrete vibrator comprises the following components as discussed in detail below. A cylindrical vibration head 5 made of steel has a closed distal end 1 and an open proximal end 11.

A brushless direct current (DC) motor 9 including a stator (not numbered) having three equally spaced windings and a rotor 7 is provided in the vibration head 5. A drive shaft 8 is provided in the vibration head 5 and has one end supported by first bearings 2 proximate to the distal end 1, the other end supported by second bearings 10, and an intermediate portion supported by third bearings 6. The drive shaft 8 passes through the rotor 7. As shown in FIG. 2, the drive shaft 8 has a lengthwise groove 81 having a concave section on an outer surface, thereby rendering the drive shaft 8 an unbalanced drive shaft. The groove 81 is formed by molding. Length and depth of the groove 81 may be changed as a choice of design.

A groove-shaped vibration member 3 is put on the drive shaft 8 and has one end limited by the first bearings 2 and the other end limited by the third bearings 6. A sleeve 4 is put on the vibration member 3. A variable-frequency drive is provided to control speed and torque of the motor 9

In operation, an operator may insert the vibration head 5 into a structure forming the body of concrete. Next, the operator may turn on the battery to power the motor 9. The activated motor 9 drives the drive shaft 8 which in turn imparts rotation to the vibration member 3. The mass distribution of the drive shaft 8 is unbalanced due to the groove 81. Thus, the vibration member 3 generates an oscillation which is coordinated with the concrete to be compacted and is transmitted to the concrete. As a result, better aggregate spreading and voids elimination in the concrete are achieved.

Further, the invention has the following advantages: The motor speed can be varied by the variable-frequency drive disposed externally. The motor is protected by overload protection and overheat protection. The drive shaft is an unbalanced mass. The vibration member is groove-shaped. Air resistance is substantially eliminated when the drive shaft rotates in a high rotational speed. The motor has an efficiency of more than 85%. Intensity of the vibration member is very strong. The concrete vibrator can be operated safely. The concrete vibrator is portable. The concrete vibrator can be operated with low noise being made. The concrete vibrator causes a minimum impact to the environment. The vibration member has a stable oscillation frequency. The concrete vibrator has a prolonged useful life.

Although the invention has been described in detail, it is to be understood that this is done by way of illustration only and is not to be taken by way of limitation. The scope of the invention is to be limited only by the appended claims.

What is claimed is:

1. A battery powered concrete vibrator comprising:

a vibration head;

a brushless direct current (DC) motor disposed in the vibration head;

a drive shaft disposed in the vibration head, rotatably disposed through the brushless DC motor, and operatively driven by the brushless DC motor, the drive shaft including a lengthwise groove on cylindrical surface thereof, thereby rendering the drive shaft axially unbalanced; and a vibration member, put on the drive shaft, and having a groove formed on an outer surface thereof;

wherein the drive shaft is capable of imparting rotation to the vibration member.

2. The battery powered concrete vibrator of claim 1, further comprising a sleeve sandwiched between the vibration member and the vibration head.

3. The battery powered concrete vibrator of claim 1, further comprising a variable-frequency drive for controlling the brushless DC motor.

4. The battery powered concrete vibrator of claim 1, further comprising a rechargeable lithium battery electrically connected to the brushless DC motor.

* * * * *